United States Patent [19]

Boyd

[11] Patent Number: 4,553,071

[45] Date of Patent: Nov. 12, 1985

[54] ELECTRONIC BALLAST FOR FLUORESCENT LAMP

[75] Inventor: Gerald D. Boyd, Grants Pass, Oreg.

[73] Assignee: Energies Technologies Corp., Grants Pass, Oreg.

[21] Appl. No.: 514,725

[22] Filed: Jul. 18, 1983

[51] Int. Cl.[4] ..... H05B 37/02

[52] U.S. Cl. ..... 315/244; 315/103; 315/239; 315/276

[58] Field of Search ..... 315/101, 103, 104, 239, 315/276, 244

[56] References Cited

U.S. PATENT DOCUMENTS

| | | | |
|---|---|---|---|
| 2,256,224 | 9/1941 | Thayer | 315/244 |
| 2,417,742 | 3/1947 | Dosio | 315/239 |
| 2,695,375 | 11/1954 | Mendenhall | 315/244 |
| 3,710,177 | 1/1973 | Ward | 315/DIG. 2 |
| 4,017,761 | 4/1977 | Woldring | 315/103 |
| 4,399,391 | 8/1983 | Hammer et al. | 315/239 |

FOREIGN PATENT DOCUMENTS

| | | | |
|---|---|---|---|
| 742356 | 12/1955 | United Kingdom | 315/244 |

*Primary Examiner*—Harold Dixon

*Attorney, Agent, or Firm*—Diller, Ramik & Wight

[57] ABSTRACT

A ballast for a fluorescent lamp including a tuned circuit in series with a pair of voltage input terminals to which an input AC voltage is applied. The tuned circuit includes a capacitor in series with an inductor, with the resonant frequency of the tuned circuit being approximately ½ the frequency of the input voltage. At start-up, the inductor is very highly reactive to provide a starting voltage which is applied to a fluorescent lamp coupled across the inductor. A positive temperature coefficient resistor is in series with the inductor to limit the current flow therethrough. The inductor forms a part of the primary winding of a transformer having a secondary winding providing the heater voltage for the lamp. A second primary winding of the transformer provides a power factor correction for the tuned circuit.

5 Claims, 1 Drawing Figure

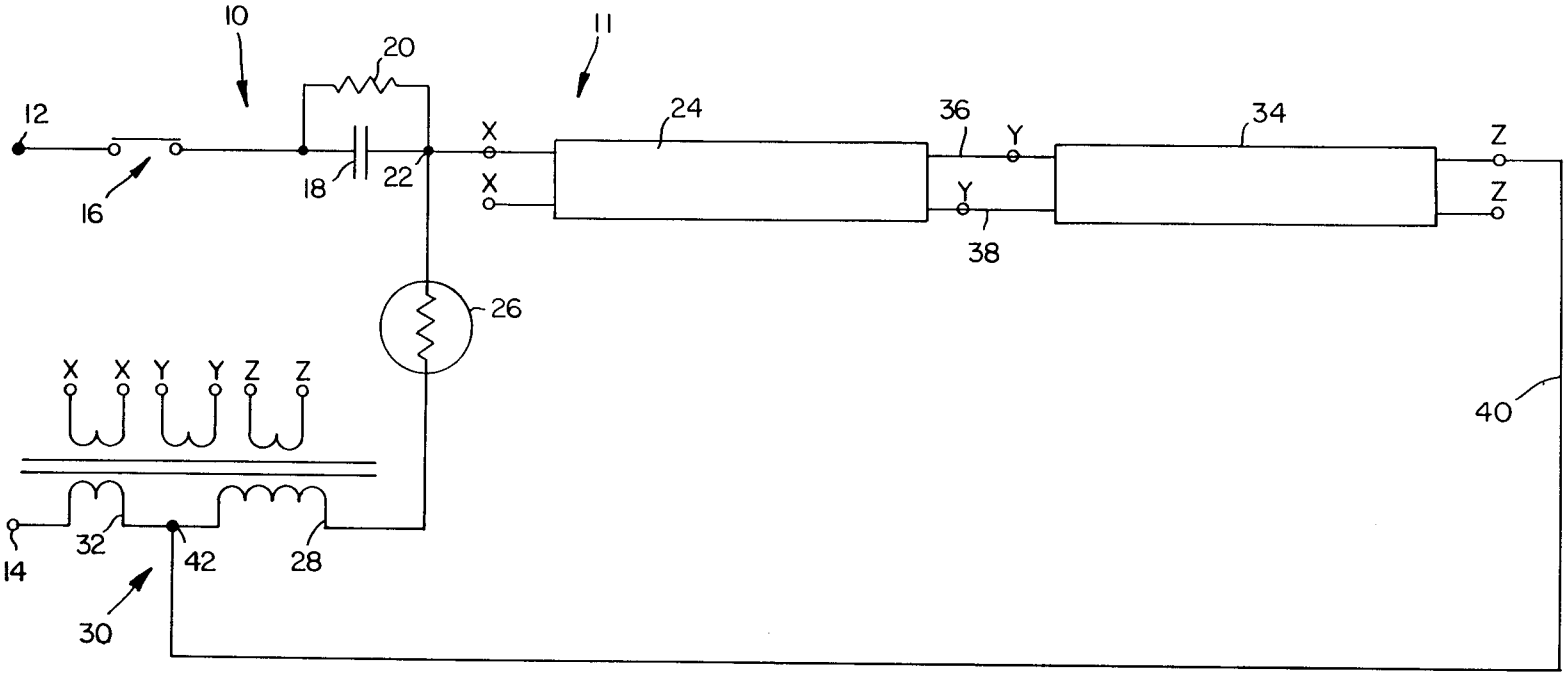
10
11
12
14
16
18
20
22
24
26
28
30
32
34
36
38
40
42
X
Y
Z

ELECTRONIC BALLAST FOR FLUORESCENT LAMP

This invention relates to improvement in a ballast for a fluorescent lamp and, more particularly, to a low frequency electronic ballast having a long operating life while minimizing energy dissipation.

BACKGROUND OF THE INVENTION

Electronic ballast devices have been known and used in the past for fluorescent lamps. In general, conventional ballast devices of this type have not been efficient in operation because of their relatively high energy requirements. Moreover, flicker of the lamps and 60 Hertz hum have been problems with conventional ballast devices. Temperatures of the ballast device are relatively high and cooling of the ballast unit must be taken into consideration to avoid overheating problems. Because of these drawbacks, a need has arisen for an improved electronic ballast device for a fluorescent lamp to avoid the above problems and to increase the operating efficiency of the circuit containing a fluorescent lamp.

Prior U.S. patents relating to ballast devices for fluorescent lamps are as follows: Nos. 4,017,761, 4,320,253, 4,358,712, 4,375,608 and 4,378,514.

SUMMARY OF THE INVENTION

The present invention satisfies the abovementioned need by providing an improved ballast unit for a fluorescent lamp which operates at relatively low temperature, is highly efficient, and minimizes the amount of energy required to operate the ballast unit itself. To this end, the present invention is comprised of a circuit assembly including a tuned circuit comprised of a capacitor and an inductor in series with each other and with a pair of input terminals to which an AC voltage is applied. One or more fluorescent lamps are coupled across the inductor and in series with the capacitor and the terminals, the capacitor providing the charge necessary for operating the lamp. The resonant frequency of the tuned circuit comprised of the capacitor and the inductor is approximately ½ the frequency of the voltage impressed upon the input terminals of the circuit assembly; thus, with the proper capacitance and inductance, a high starting voltage is generated to start the lamp after the heaters of the lamp have been energized.

The current through the inductor can be controlled by a positive temperature coefficient resistor so as to prevent damage to the inductor yet provide the necessary starting voltage for the lamp. Once the lamp has been started, the voltage across the inductor will be clamped to a relatively low value yet this voltage will tend to increase at any time in which the lamp appears not to ignite properly to thereby assure the proper starting voltage as well as the proper operating voltage.

The inductor forms a part of the primary winding of a transformer having a secondary winding provided for heating the heaters of the lamp. A second part of the primary winding of the transformer is used for power factor correction. A bleed resistor can be provided across the capacitor, and a thermal breaker switch can be coupled in series with the capacitor and the inductor for safety purposes.

The primary object of the present invention is to provide an improved electronic ballast unit for a fluorescent lamp wherein the unit includes a tuned circuit which provides a high starting voltage applied to a fluorescent lamp coupled across a reactive element of the tuned circuit to thereby energize the lamp in operation once it has been started.

Other objects of the present invention will become apparent as the following specification progresses.

DESCRIPTION OF THE DRAWING:

The single FIGURE of the drawing shows a schematic view of the ballast limit of the present invention.

The ballast unit of the invention is broadly denoted by the numeral 10 and is used with the circuit assembly 11 of the drawing. Unit 10 includes a pair of input terminals 12 and 14 across which an AC voltage is impressed. Terminal 12 is coupled to a thermal breaker switch 16 in series with a capacitor 18 across which is a bleeder resistor 20. One terminal 22 of capacitor 18 is coupled to a first fluorescent lamp 24 and is also coupled to a positive temperature coefficient resistor 26 which is in series with a first inductor 28 forming a first part of the primary of a transformer 30. The first inductor 28 is coupled with a second inductor 32 forming a second part of transformer 30, and inductor 32 is coupled to terminal 14.

Lamp 24 is shown as being coupled in series with a second fluorescent lamp 34 by way of leads 36 and 38, the other end of lamp 34 being coupled by a lead 40 to a junction 42 between inductors 28 and 32.

Transformer 30 has three secondary windings for supplying heater voltages to lamps 24 and 34. The output terminals of the secondary windings are denoted by x—x, y—y, and z—z. These winding terminals are coupled to corresponding terminals x—x, y—y and z—z shown in the drawing at the ends of lamps 24 and 34.

Resistor 20 is a bleeder resistor to discharge capacitor 18 in accordance with U.L. requirements. Capacitor 18 is a coupling capacitor to transfer energy or charge to lamps 24 and 34. The value of this capacitor determines the charge and, therefore, the brightness of the lamps. Typically, capacitor 18 has a capacitance of about 2 mfd when the input voltage is about 277 volts R.M.S.

Transformer 30 has several functions, the first of which is to supply heater voltage to lamps 24 and 34 through the secondary windings of the transformer. Inductor 28 serves as a starting winding for the lamps, and inductor 32 serves as a power factor correction and filter unit.

Capacitor 18 and inductor 28 form a tuned circuit which resonates at approximately ½ the frequency of the AC input supply voltage. Thus, inductor 28 appears very inductively reactive so that, at a input voltage frequency of 60 Hz, the voltage across inductor 28 will be a number of times greater than the input voltage, depending upon the combined Q of circuit 10. The Q is determined by the equivalent series resistance of capacitor 18 and the series resistance of inductor 28. The voltage across inductor 28, therefore, can be set by using the proper number of turns in the winding of inductor 28 to allow for the correct starting voltage for lamps 24 and 34 coupled across inductor 28.

It should be noted that the current flowing in inductor 28 can be very high because of the off resonant condition that exists because the resonant frequency of the tuned circuit is different from the frequency of the input AC voltage. The positive temperature coefficient resistor 26 is used to limit the amount of time in which this high current condition exists. Without resistor 26, the high current condition through inductor 28 would be self-destructive and would damage inductor 28 after a short period of time. Resistor 26 has been selected to open the circuit between capacitor 18 and inductor 28 after about 10 seconds.

Under normal starting conditions with a lamp across inductor 28, this high voltage condition would only exist for a few seconds. Once the lamp starts, it will clamp the voltage across inductor 28 down to a low value. In doing so, it destroys the Q of the circuit. If, at any time, the lamp should not continue to ignite properly, this voltage across the inductor will increase to ensure proper continued operation.

In operation, and upon turn-on of the AC power with the circuit connected as above, the operation of the circuit is as follows:

The low heater resistance of the lamps at turn-on will reflect a load back to inductor 28 such that it will destroy the Q of the tuned circuit and the high starting voltage will not appear. As the lamp heaters warm up the lamp, the lamp heater resistance increases to a value that allows the correct Q for the tuned circuit and, therefore, the voltage across inductor 28 increases to a value to start the lamps. In doing this, the circuit assembly 11 automatically allows for a preheat for the lamps before turn on of the lamps.

After lamp turn-on, the voltage across inductor 28 is reduced to a low value because of the clamping action of the lamps when ignited. This clamped lower voltage will be about ½ of the starting voltage and appears across inductor 28. This lower voltage, after lamp turn on, results in lower voltages for the lamp heaters after turn on. This reduced heater voltage will be about ½ the value appearing at turn on and will be adequate to maintain proper heater temperature during operation.

Inductor 32 is used for power factor correction. Inductor 32, together with capacitor 18, forms a series resonant circuit at a 80 Hz. This circuit removes the current spike associated with the lamp turn on and smooths out the current wave form to improve the power factor of the ballast system represented by circuit 10. The present invention, therefore, provides a low frequency (60 Hz) solid state electronic ballast.

The invention operates at a relatively cool temperature to contribute to its long operating life in comparison to a conventional ballast. Flicker and hum are not present in the operation of the present invention because the invention operates at a relatively cool temperature, there is very little power wasted in the unit which results in energy savings which can run as high as approximately 35% in the operation of fluorescent lamps.

What is claimed is:

1. An electronic ballast unit for a fluorescent lamp comprising: a circuit assembly having a capacitor and an inductor in series relationship with each other comprising a circuit tuned to a first frequency, said circuit assembly having a pair of input terminals for applying an AC voltage having a second frequency to the circuit assembly, wherein said first frequency is less than said second frequency, such that said circuit assembly is not tuned to the frequency of said AC voltage; means across said inductor for coupling a fluorescent lamp to the circuit assembly, said inductor being sufficiently reactive to produce a starting voltage a number of times greater than the input voltage, whereby the starting voltage can be used for energizing the fluorescent lamp; and a bleed resistor connected across said capacitor.

2. A ballast unit as set forth in claim 1 wherein is included a positive temperature coefficient resistor in series with the inductor.

3. A ballast unit as set forth in claim 1, and further including a transformer having a primary winding, wherein said primary winding comprises said inductor.

4. A ballast unit as set forth in claim 3, and further including a positive temperature coefficient resistor in series with said inductor.

5. A ballast unit as set forth in claim 3, wherein said fluorescent lamp has heaters, and wherein the transformer has a secondary winding adapted to be coupled to the heaters of the fluorescent lamp.

* * * * *

UNITED STATES PATENT AND TRADEMARK OFFICE

CERTIFICATE OF CORRECTION

PATENT NO. : 4,553,071

DATED : November 12, 1985

INVENTOR(S) : Gerald D. BOYD

It is certified that error appears in the above-identified patent and that said Letters Patent is hereby corrected as shown below:

In the "Heading" under the caption "Assignee":

"Energies Technologies Corp." should read as follows:

-- Energy Technologies Corp. --

Signed and Sealed this

*Sixth* Day of *May 1986*

[SEAL]

*Attest:*

DONALD J. QUIGG

*Attesting Officer*

*Commissioner of Patents and Trademarks*